US008567334B1

(12) United States Patent
Matlin et al.

(10) Patent No.: US 8,567,334 B1
(45) Date of Patent: Oct. 29, 2013

(54) SYSTEM FOR AIDING LINE HANDLING WHEN DOCKING A BOAT OR OTHER VESSEL

(76) Inventors: Gerald Matlin, Stamford, CT (US); Vincent Grasso, Bedford Hills, NY (US)

( * ) Notice: Subject to any disclaimer, the term of this patent is extended or adjusted under 35 U.S.C. 154(b) by 121 days.

(21) Appl. No.: 13/337,455

(22) Filed: Dec. 27, 2011

(51) Int. Cl.
*B63B 21/00* (2006.01)

(52) U.S. Cl.
USPC ..... 114/230.2; 114/230.25; 114/230.1

(58) Field of Classification Search
USPC ..... 114/230.2, 230.25, 230.26, 230.15, 114/218, 230.1, 230.11
See application file for complete search history.

(56) References Cited

U.S. PATENT DOCUMENTS

| | | | | |
|---|---|---|---|---|
| 2,811,127 | A * | 10/1957 | Palsson | 114/221 R |
| 3,120,831 | A | 2/1964 | Fulton | |
| 3,151,595 | A * | 10/1964 | Stainbrook | 114/230.25 |
| 3,330,244 | A | 7/1967 | Page | |
| 4,073,255 | A | 2/1978 | Paul | |
| 5,036,787 | A | 8/1991 | Rogers | |
| 5,154,132 | A | 10/1992 | Brushaber | |
| 5,513,592 | A | 5/1996 | Cotton | |
| 5,520,134 | A | 5/1996 | Walker | |
| 7,789,033 | B2 | 9/2010 | Doig et al. | |

FOREIGN PATENT DOCUMENTS

GB 2226998 A * 7/1990

* cited by examiner

*Primary Examiner* — Edwin Swinehart
(74) *Attorney, Agent, or Firm* — Goldstein Law Offices, P.C.

(57) ABSTRACT

A boat docking device, for use with a boat, a dock adjacent to a body of water, and dock lines each having a fixed end secured to the dock, and a free end. The docking device has a mast that is secured to the dock, and an arm that is secured to the mast and is selectively pivotable between an extended position substantially perpendicular to the dock, and a retracted position substantially parallel to the dock. The arm has a lower surface having a plurality of clips for holding the dock lines as they extend substantially parallel to the arm along the lower surface with the free end of dock lines available at the distal end so when the arm is extended perpendicular to the dock and over the body of water, the boater can grab the free end before the boat reaches the dock.

16 Claims, 14 Drawing Sheets

SYSTEM FOR AIDING LINE HANDLING WHEN DOCKING A BOAT OR OTHER VESSEL

TECHNICAL FIELD

The present disclosure relates generally to a system for aiding in the handling of dock lines when docking a vessel. More particularly, the present disclosure relates to a system for aiding the captain, deckhand, or occupants of a vessel in quickly and easily procuring dock lines as the vessel approaches a dock, to facilitate securing the vessel to the dock.

BACKGROUND

A sea-going, waterborne vessel—sometimes called a boat, yacht, ship is designed to move about a body of water in which it is buoyant, according to the direction of the captain when operating under its own power and using its own propulsion and directional parts, features, and adaptations. A vessel that is not operating under its own power, however, will move upon the body of water in accordance with the currents, waves, and winds. Accordingly, any non-operating vessel that is not on dry land must remain anchored, moored, or tied to a dock at all times, lest it go 'anywhere the wind blows'.

To facilitate tying a boat to a dock, modern vessels and docks generally have "cleats", which facilitate attachment of a rope which is known as a line. To secure the boat, one or more lines are secured between a cleat on the dock and a cleat on the boat, and are subsequently released on one or both ends to free the boat from the dock. While a variety of different techniques exist for tying a boat to a dock, including to allow for changes in current, wind, and tide while the boat is docked and left unattended, such techniques and configurations are beyond the scope of the present discussion.

Especially when a departing boat intends to return to the same dock, either one or more lines is left secured to the dock, or one or more lines is kept tied to the boat cleat—ready to be brought onto the dock to tie to a dock cleat. When the boat returns to the dock, then, the captain, deckhand, or other occupant of the boat must somehow either retrieve the line and bring it on board so that it can be secured to one of the cleats on the boat, or get the line onto the dock to secure it there. Since a boat is limited in its directional ability as power is reduced, docking can be clumsy, and having at least one line between the boat and dock creates a valuable link that allows the boat to be quickly stabilized. The obvious difficulty, however, is retrieving the line from the dock to secure the boat to the dock (or vice-versa), while the boat is still unsecured and remains subject to winds, currents, and waves. This problem is exacerbated by the fact that as the boat approaches the dock, since propulsion is typically greatly reduced or stopped to avoid striking the dock with the boat, and as a result, the controlling the boat enough to even retrieve the line can be quite difficult.

With larger maritime operations, line handling can be simplified by the presence of multiple deck hands and often dock hands who can 'throw a line' to/from the boat. Lines for such vessels can be extremely heavy and by themselves can cause injury. With smaller, especially recreational boating, however, the captain is often alone to not only pilot the boat, but also make the connection with the dock, while avoiding having the boat strike the dock and also avoiding 'falling in the drink'. Even when another occupant is present, they are often required to jump off the bow to grab the line (or carry and tie the line) and perhaps also manually prevent the boat from striking the dock—once again carrying a significant risk of injury.

For a recreational boater, then the prospect of later returning to the dock and dealing with docking, can be enough to prevent the boater from even leaving the dock! When currents or winds are significant, or forecast as significant, just the thought of docking later can be enough to have the boater think twice about an excursion, or to distract from enjoyment of the same.

Over the years various devices have been developed, proposed, and attempted to aid the boater with docking. While these units may be suitable for the particular purpose employed, or for general use, they would not be as suitable for the purposes of the present invention as disclosed hereafter.

BRIEF SUMMARY

It is a possible object of the present disclosure to provide a system that aids a boater in docking operations by facilitating the boater in retrieving one or more lines that are secured to the dock, as the boater approaches the dock. Accordingly, the present system may include a device that is configured to hold one or more lines in a position where it may be easily grabbed by an occupant of the boat It is another possible object of the present disclosure to provide a system that holds the line at a convenient height above the water and convenient distance from the dock. Accordingly, such a device may include an arm that holds a free end of the line at such an appropriate position.

It is yet another possible object of the present disclosure that such arm may be configured to selectively hold the line in space over the water, adjacent to the dock, and also to not interfere with the vessel when secured to the dock—especially for use with vessels which have portions that project significantly above its water line. Accordingly, such arm may be configured to selectively swing between an extended position perpendicular to the dock, and a retracted position parallel to the dock.

It is a further possible object of the disclosure that such arm can be configured so it can be easily brought into the extended position, as the boat leaves the dock. Accordingly, the arm may have an extension adaptation at its distal end, to allow an occupant of the boat to pull the arm into the extended position.

It is yet a further possible object of the disclosure that such arm can be positioned to be within arm's length of the occupant—for a variety of different sized vessels and people. Accordingly, the arm may be constructed to be easily user-adjustable in height.

It is a still further object of the disclosure that such arm will remain in position until repositioned by the user, and can effectively resist changing positions due to the influence of winds. Accordingly, the arm may be configured to lock in both the perpendicular and extended positions.

It is an even still further possible object of the disclosure that such a device can be easily and firmly secured to the dock, without requiring permanent installation and without damaging the dock. Accordingly, the device may be configured or adapted to attach to standard cleats, that already exist on the surface of the dock.

The present disclosure presents a boat docking device, for use with a boat, a dock adjacent to a body of water, and dock lines each having a fixed end secured to the dock, and a free end. The docking device has a mast that is secured to the dock, and an arm that is secured to the mast and is selectively pivotable between an extended position substantially perpendicular to the dock, and a retracted position substantially parallel to the dock. The arm has a lower surface having a plurality of clips for holding the dock lines as they extend substantially parallel to the arm along the lower surface with the free end of dock lines available at the distal end so when the arm is extended perpendicular to the dock and over the body of water, the boater can grab the free end before the boat reaches the dock.

To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

The following detailed description is provided to provide a workable example to those possessing ordinary skill in the art. While direct assertions are made about elements and their interconnection, such assertions are made for the sake of providing a clear example of the present device and system. Such assertions are not intended to be construed as in any way limiting upon the broadest interpretation of the appended claims permitted by law.

Figure 1:
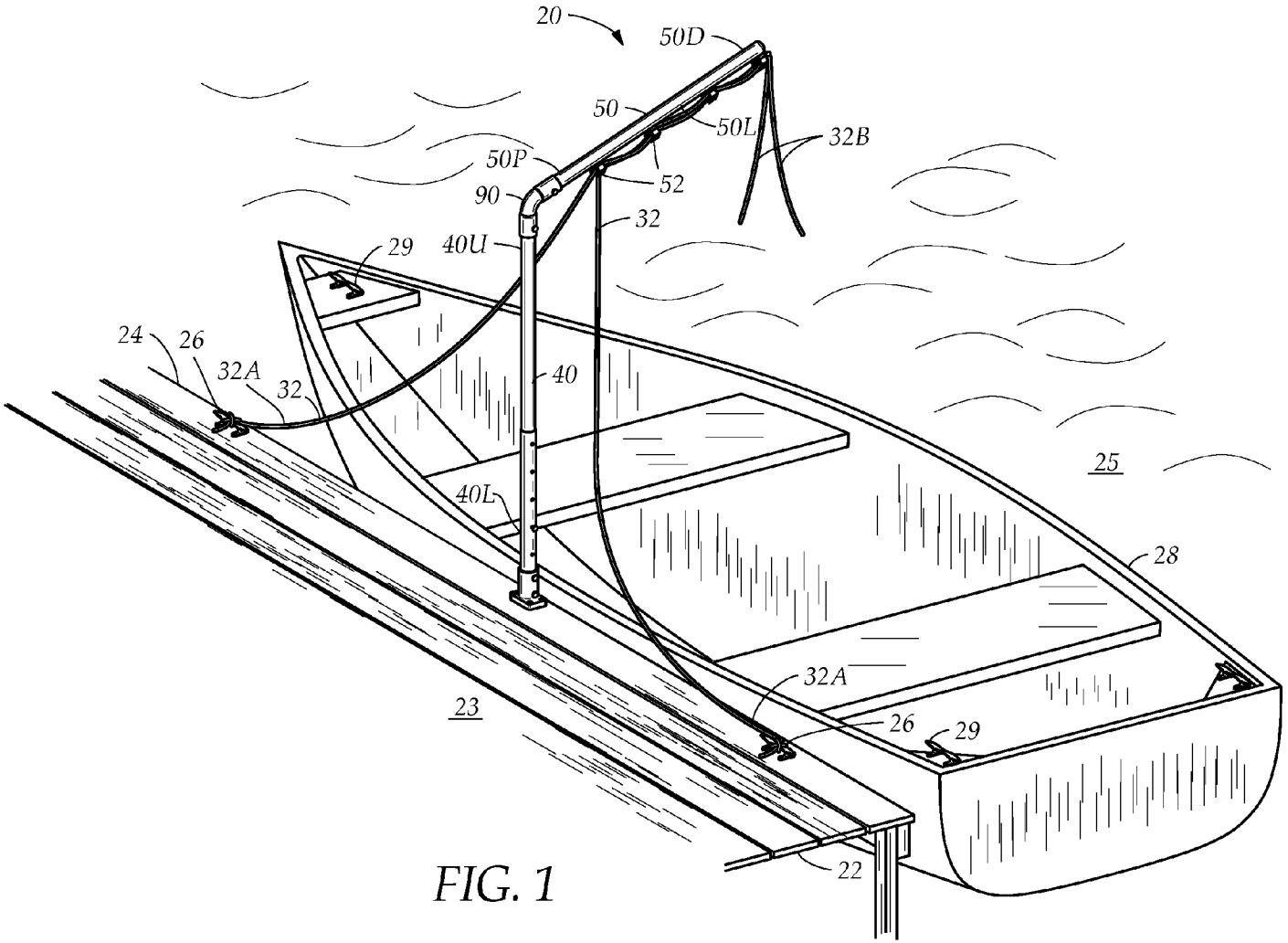
FIG. 1 is diagrammatic perspective view, illustrating an embodiment of a boat docking device, having an arm in an extended position, perpendicular to the dock, positioning the lines ready to be grasped by an occupant on the boat. Note that the particular size of the boat as rendered has been selected for clarity of illustration only, and in no way limits the context for the docking device as described herein.

FIG. 1 illustrates a boat docking device 20, secured to a dock 22, having a dock surface 23 and a dock edge 24. Dock cleats 26 are fastened to the dock 22, near the dock edge 24. The dock edge 24 is adjacent to a body of water 25. A boat 28 is buoyant upon the body of water 25, has one or more boat cleats 29, and is positioned adjacent to the dock edge 24. Dock lines 32 are available for securing the boat 28. In particular, each dock line 32 has a fixed end 32A which is secured to one of the dock cleats 26, and a free end 32B.

Figure 6:
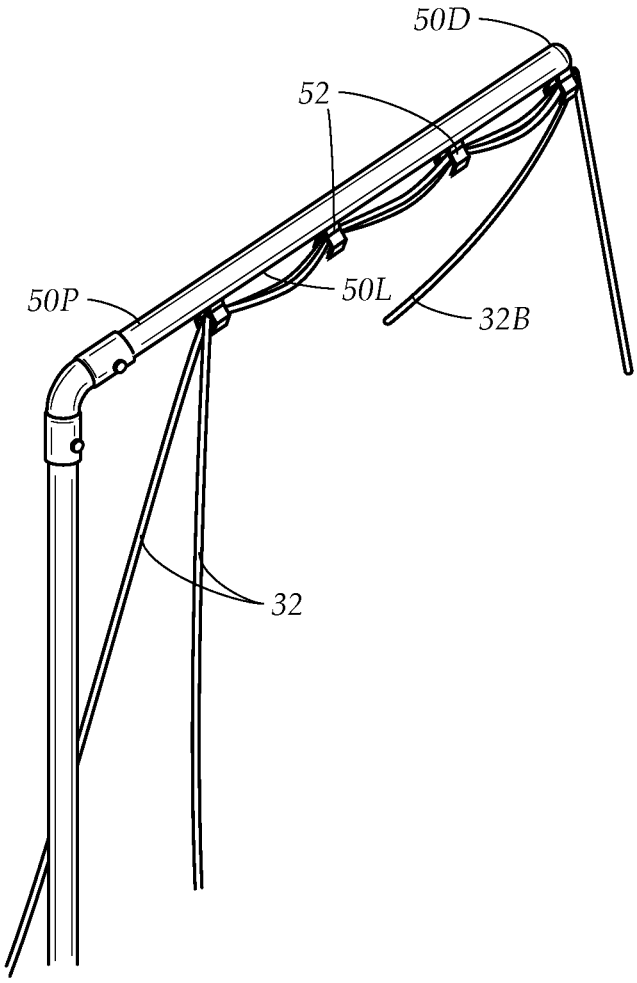
FIG. 6 is a diagrammatic perspective view, illustrating the arm, wherein a pair of lines are held in place by a primary clip arrangement.
Figure 7:
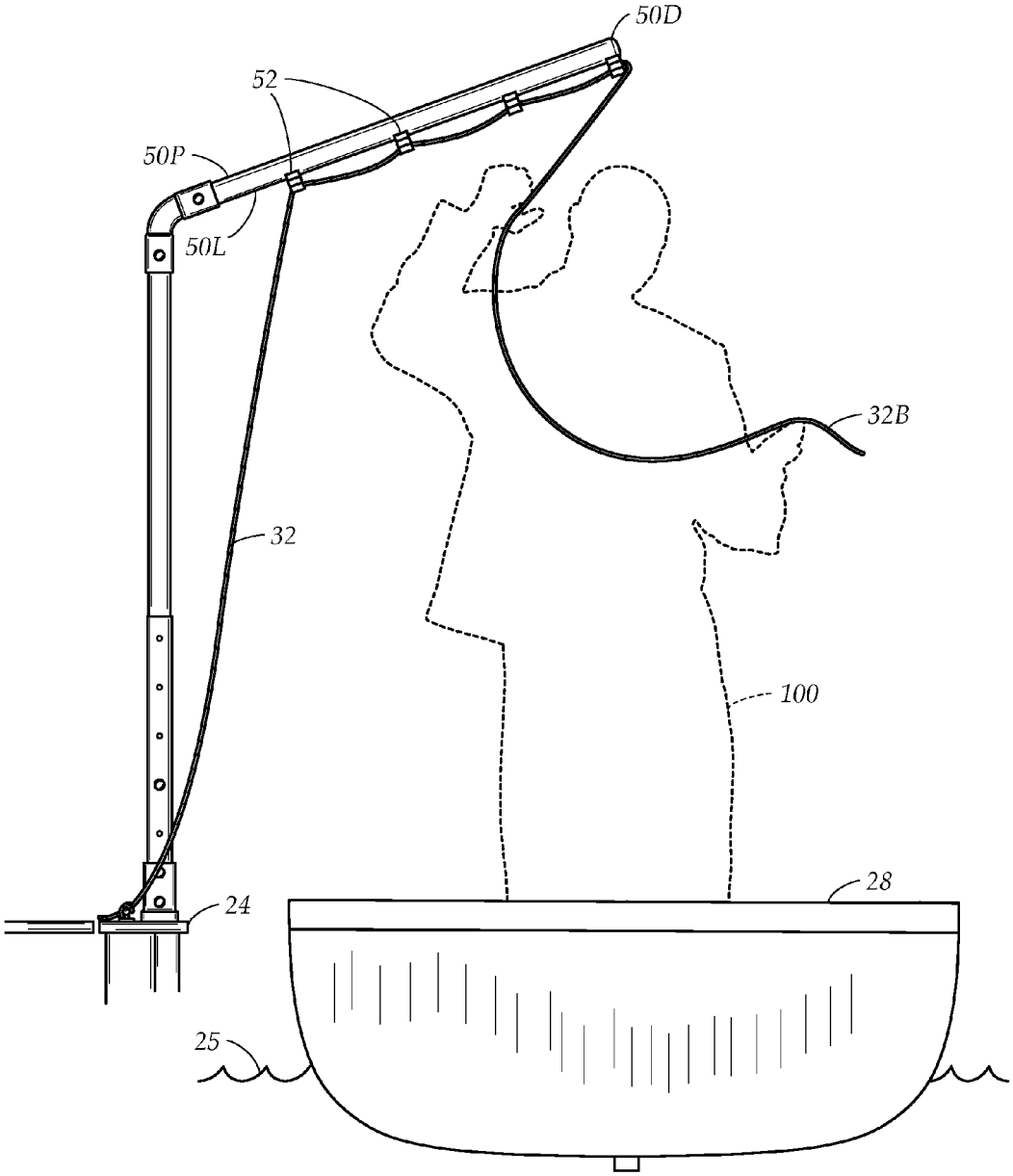
FIG. 7 is a diagrammatic perspective view, illustrating the arm, illustrating a boat occupant grasping the lines being held by the arm.

The boat docking device 20 includes a mast 40, and an arm 50. The mast 40 and arm 50 may be joined by any suitable means—such as the elbow 90 illustrated—at an an angle that is substantially perpendicular or obtuse. The mast has a lower end 40L that is secured to the dock 22, and an upper end 40U that is secured to the arm 50. The arm 50 has a proximal end 50P, and a distal end 50D. The arm 50 has a lower surface 50L, and a primary clip arrangement which includes a plurality of clips 52 positioned on the lower surface 50L and spaced between the proximal end 50P and distal end 50D. Referring simultaneously to FIGS. 1, 6, and 7 The dock lines 32 extend along the lower surface 50L of the arm 50 and are held in place by the clips 52, such that the free end 32B of each of the dock lines 32 dangles from and is available to be grasped at the distal end 50P of the arm 50. As the boat 28 approaches the dock, with the arm 50 extending beyond the dock edge 24 and over the water 25, a boater 100 is able to grasp the free end 32B of the dock lines 32 before the boat 28 even reaches the dock 22.

Figure 8:
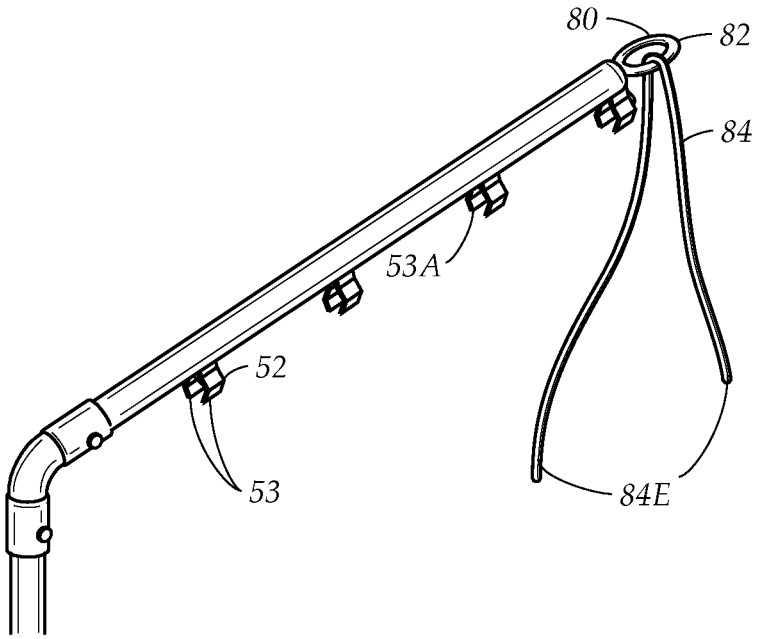
FIG. 8 is a diagrammatic perspective view, illustrating an embodiment of the device, having an extension adaptation at the distal end of the arm.

Referring now to FIGS. 6 and 8, the clips 52 each have a pair of jaws 53 that defines a downward facing opening 53A that may be selectively enlarged and reduced in size. The jaws 53 are configured to exert a spring force that biases the jaws 53 closed. Such spring force is tuned so that the opening will remain sufficiently closed to hold the dock lines 32, yet open sufficiently to release the dock lines 32 in response to a gentle but deliberate force.

Figure 2:
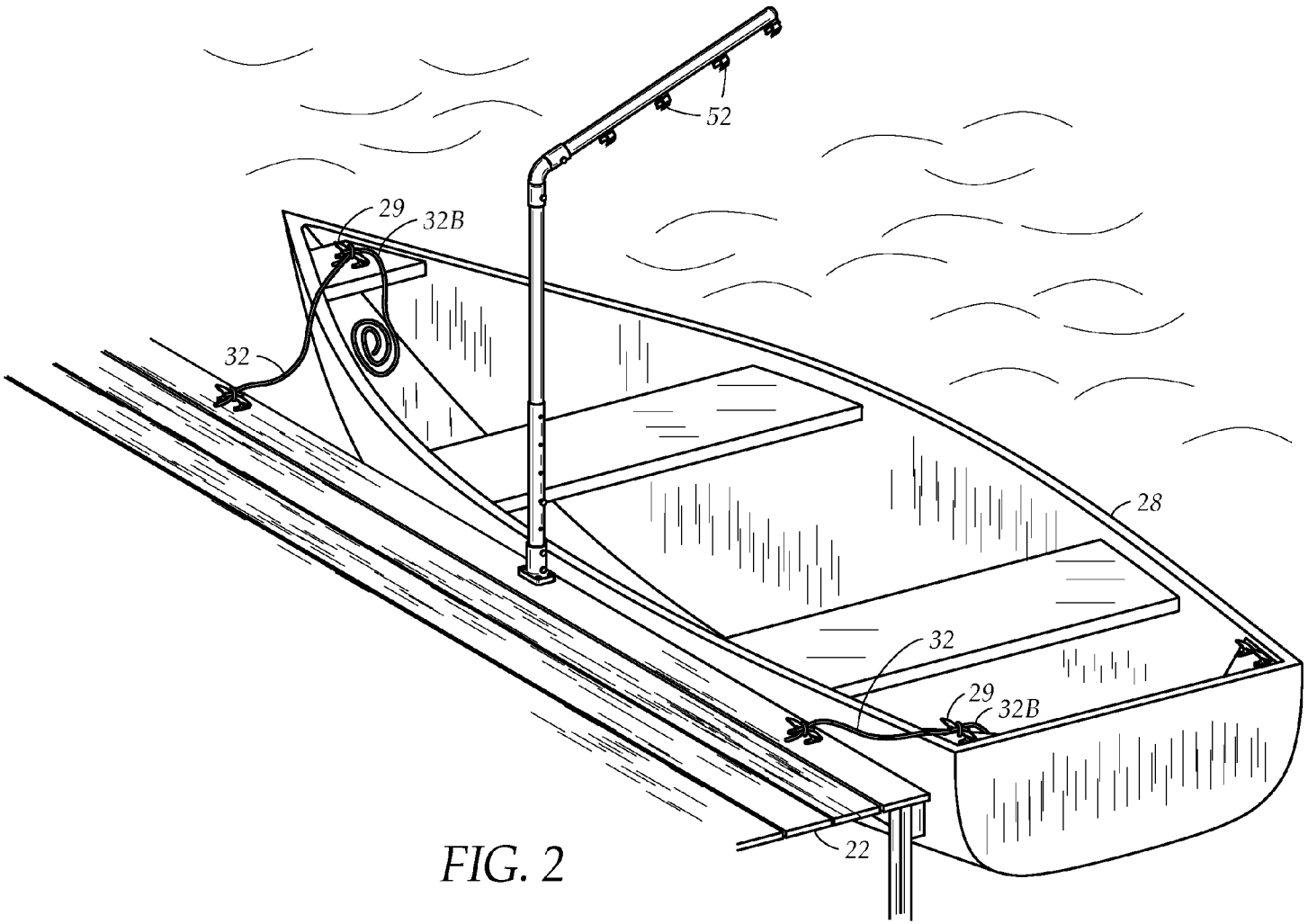
FIG. 2 is a diagrammatic perspective view, similar to FIG. 1, wherein the boat is secured to the dock using a pair of lines. Note that the particular manner of securement is meant as a simplistic illustration of use of the apparatus described herein, and is not intended to reflect, nor limited to any particular boat handling or line tying technique(s).

Referring to FIG. 2, the clips 52 have released the dock lines 32, such that they were then be used to secure the boat 28 to the dock 22 by securing the free end 32B of each of the dock lines 32 to one of the boat cleats 29. Note once again, that the particular manner of "tying up" the boat in the drawing figure, and the type and size of vessel shown, is illustrated as it is for the sake of simplicity, and is in no way intended to indicate the proper or appropriate manner of line handling—which is beyond the scope of the present discussion—and is in no way limiting to the potential use of the device or system described herein.

Figure 3:
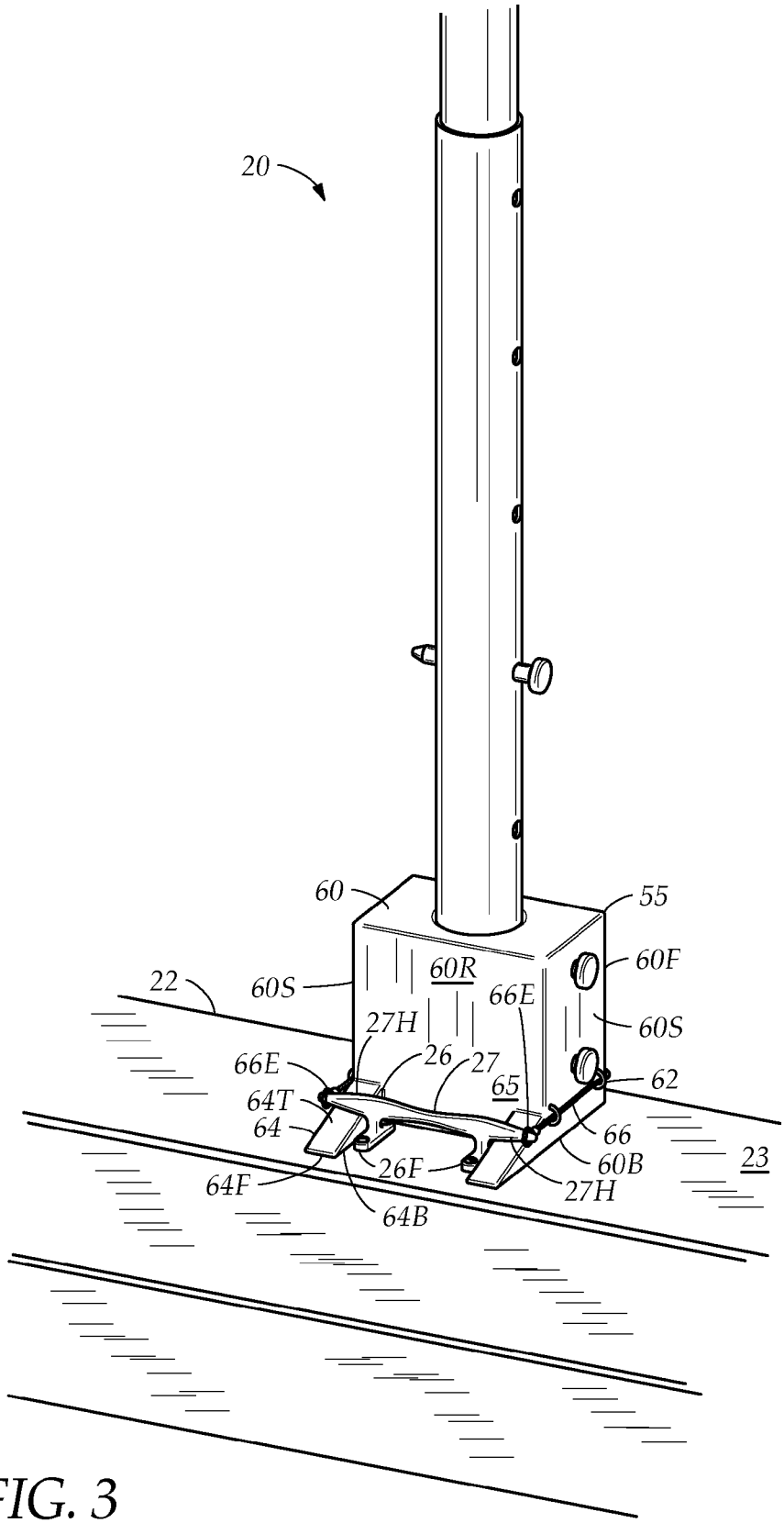
FIG. 3 is a diagrammatic perspective view, illustrating an embodiment of the boat docking device, configured to attach to a dock mounted cleat.
Figure 4:
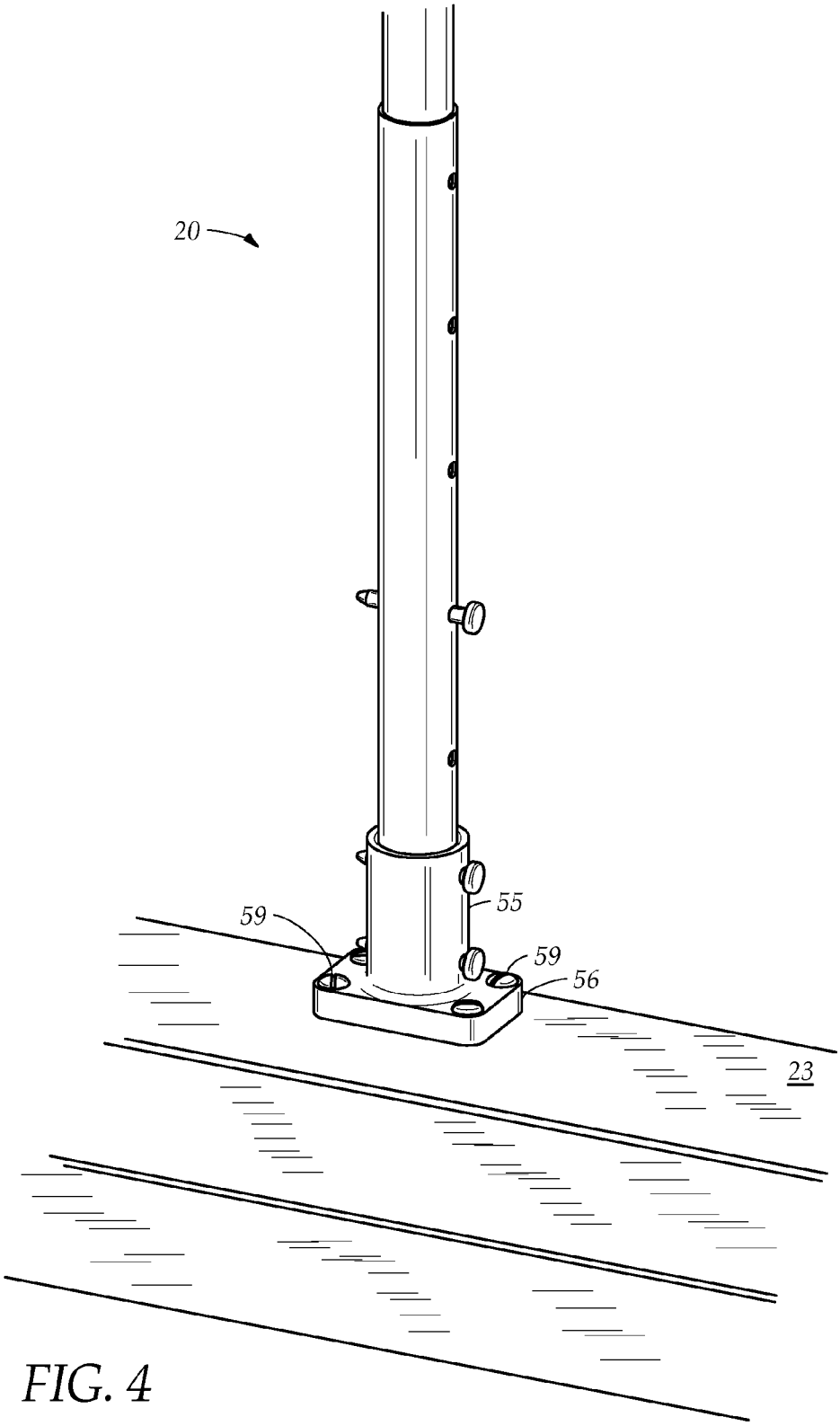
FIG. 4 is a diagrammatic perspective view, illustrating an embodiment of the boat docking device, configured to secure directly to a dock.
Figure 5A:
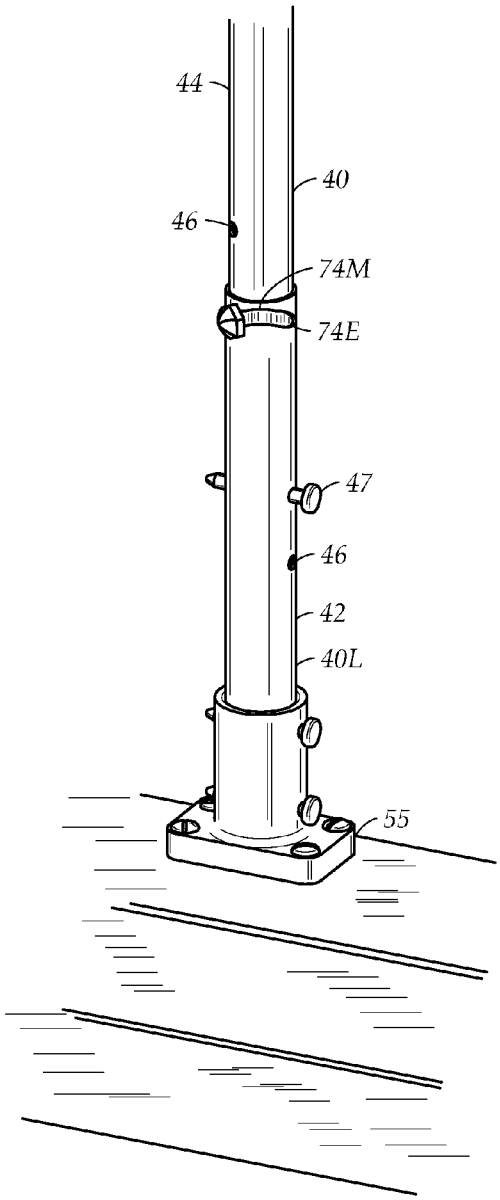
FIGS. 5A and 5B illustrate the boat docking device in alternate pivotal positions, allowed in part by a pivoting mechanism as illustrated.
Figure 5B:
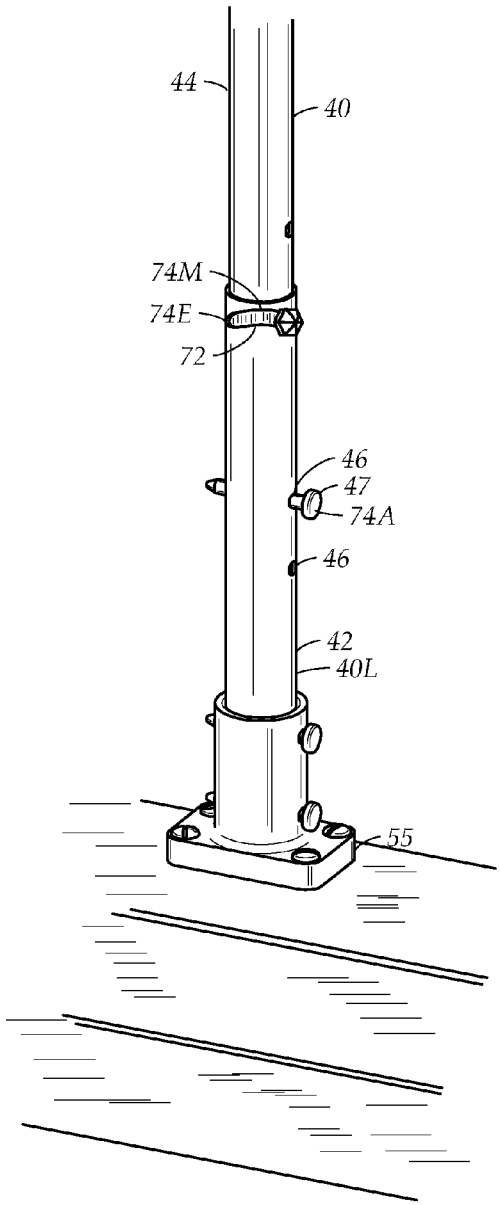
Figure 5C:
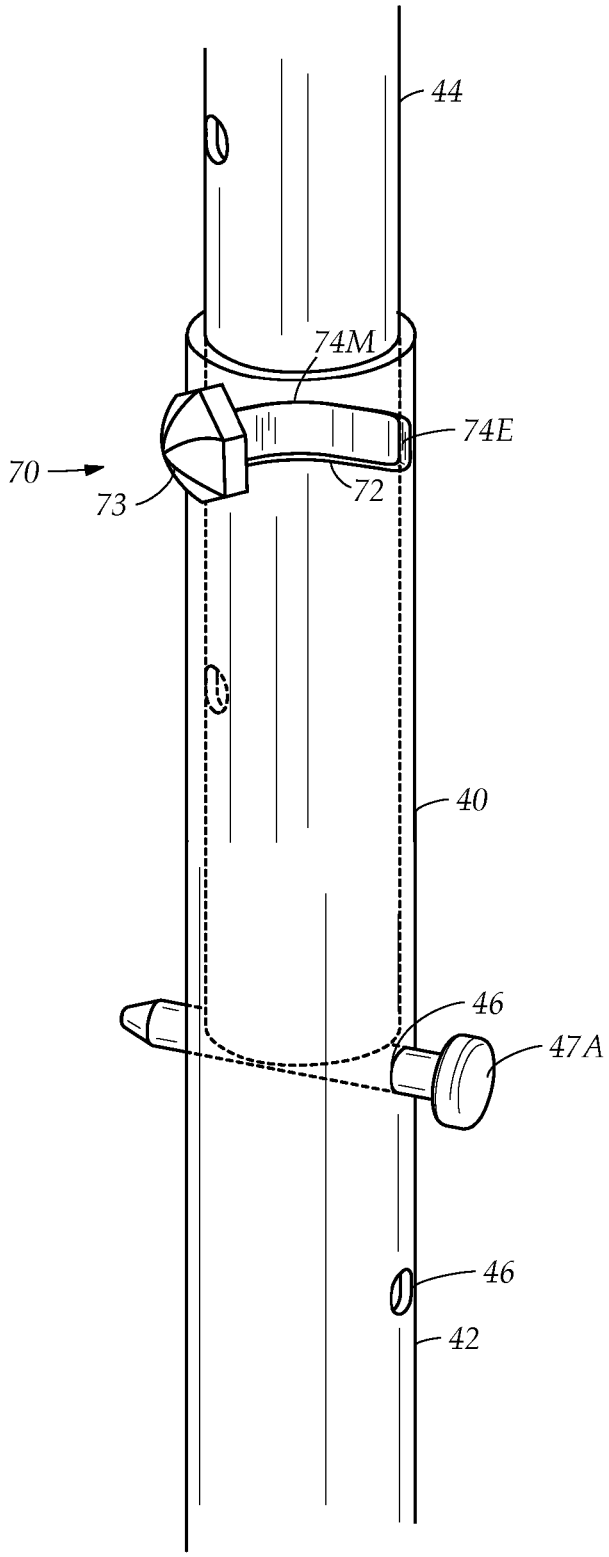
FIG. 5C is a diagrammatic perspective view, enlarging a portion of FIGS. 5A and 5B, and further illustrating a mechanism for height adjustment of the arm.
Figure 5D:
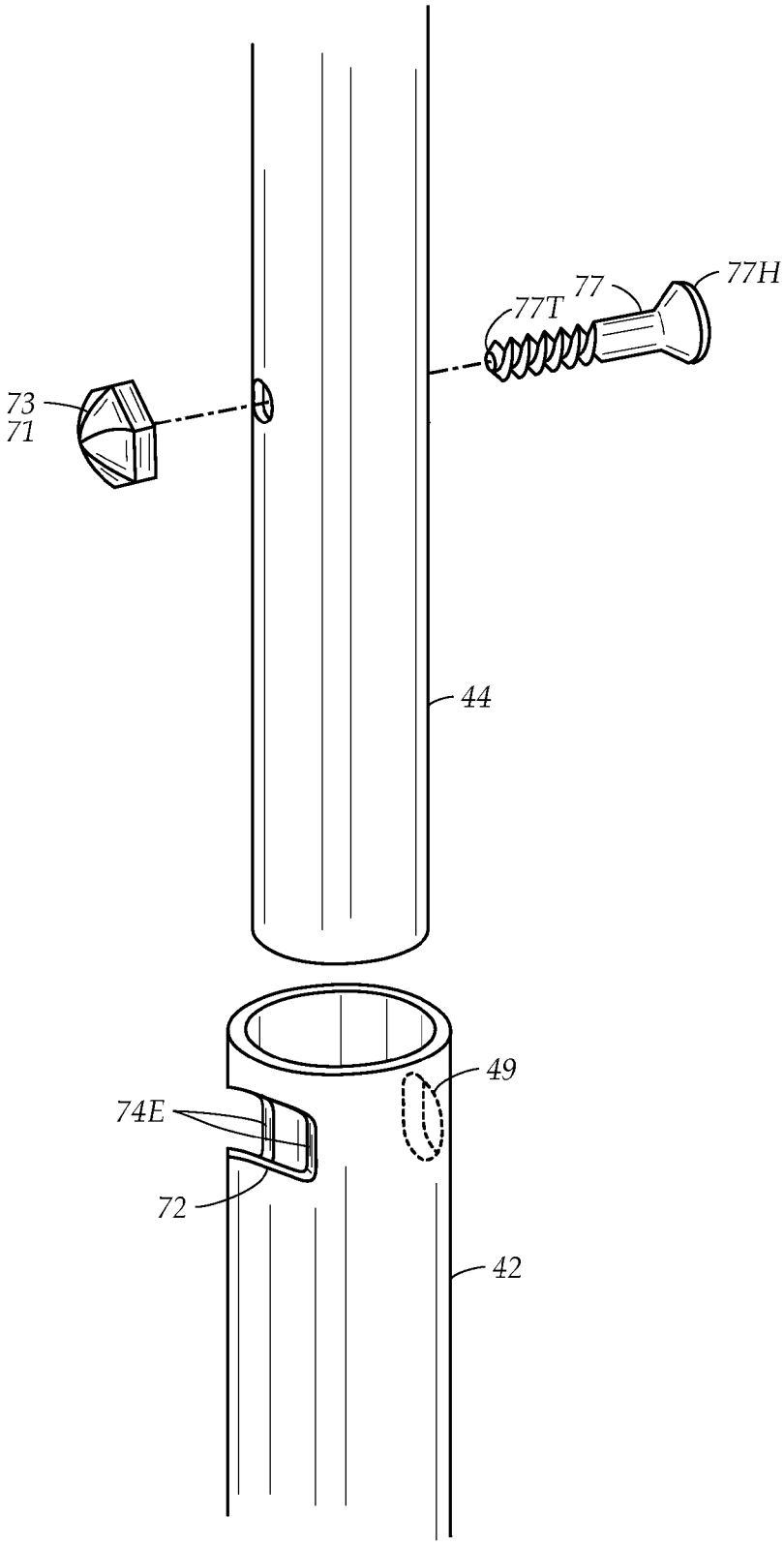
FIG. 5D is a diagrammatic perspective view, further illustrating the pivoting mechanism.

FIG. 3 and FIG. 4 provide two examples of possible manners of securing the boat docking device 20 to the dock surface 23. In particular, the docking device 20 has a base 55 that may be secured to the lower end 40L of the mast by various means. In the embodiment illustrated in FIG. 4, the base 55 has a flange 56 with a plurality of thru holes 58, that allow fasteners 59 such as screws, bolts, or the like—to secure the flange 56 and thus the docking device 20, directly to the dock surface 23.

FIG. 4 illustrates an embodiment of the boat docking device 20 which does not require direct securement to the dock surface 23, but instead allows indirect securement using the already existing dock cleats 26. The dock cleat 26, seen here in further detail, has a pair of feet 26F which are secured directly to the dock 22, and has a main body 27 which extends between the feet, suspended a short distance above the dock 22 thereby. The feet 26F are are spaced at a distance that may be referred to as a 'feet spread'. The main body 27 includes a pair of horns 27H which jut outwardly, beyond the feet 26F, in opposite directions.

To work in conjunction with this and similar dock cleats 26 and in accordance with this embodiment, the base 55 includes a base block 60 and a strap 66. The base block 60 has a front face 60F, a rear face 60R, a bottom surface 60B, and a pair of side faces 60S. Each of the side faces 60S has a pair of strap guides 62 at substantially the same height above the bottom surface 60B. Note that a pair of strap guides may also be located on the front face 60F. The base block 60 has a pair of wedges 64 that extend from the rear face 60R adjacent to the bottom surface 60B, and have a space 65 between the wedges that is at least the feet spread of dock cleats 26 with which it is to be used. Each of the wedges 64 has a top surface 64T, a bottom surface 64B, and a forward edge 64F that is fully opposite from the base block 60. The bottom surface 64B of said wedge 64 extends substantially parallel to the bottom surface 60B of the base block 60. The top surface 64T of said wedge 64 tapers downwardly toward its bottom surface 64T, as it extends outwardly from the rear face 60R of the block toward the forward edge 64F.

To secure the docking device 20 to the dock cleat 26, the base block 60 is positioned immediately adjacent to one of the dock cleats 26. The wedges 64 are extended beneath the horns 27H until the top surface 64T of each of the wedges rests snugly against one of the horns 27H, and the bottom surface 64B rests snugly against the dock surface 23. With the base block 60 effectively wedged in place beneath the dock cleat 26, further security is provided by the strap 66, which extends around the base block 60 and is secured to the horns 27H. In particular, the strap 66 has a pair of strap ends 66E. One of the strap ends is secured to one of the horns 27H, the strap 66 is extended through the strap guides 62 along one of the side faces 60S of the base block, around the front face 60F of the base block 60 (and through strap guides on the front face 60F if present thereon), through the strap guides 62 along the other of the side faces 60S, and the other of the strap ends 66E attaches onto the other horn 27H. The strap guides provide an effective connection between the base block 60 and strap 66 so that the strap 66 cannot slip off of the base block 60. Note that the strap may have loops on its ends 66E as illustrated, may also be a wire that is pulled tight and then wrapped around the each horn to provide a tensioned connection, or any other suitable configuration or material to accomplish the desired connection between the base block and dock cleat. It should also be noted that while the example provided illustrates the front face and side faces as discrete surfaces, they may also combine as one contiguous curved surface that spans opposite the rear face.

To make the docking device adaptable for different size and different types of vessels, one desirable feature for the docking device 20 is for it to have the ability to pivot between an extended position, wherein the arm 50 is substantially perpendicular to the dock edge 23, and a retracted position, wherein the arm 50 is substantially parallel to the dock edge 23. Accordingly, FIGS. 5A, 5B, 5C, and 5D, show an exemplative mechanism to allow such pivoting within a ninety degree field of motion, as well as for height adjustment, to position the arm at a desirable height. In particular, the mast 40 may comprise two or more telescoping tubes to facilitate easy height adjustment, and also pivotal adjustment of the arm 50. As illustrated in 5A-5D, the mast 40 includes a lower tube 42, and an upper tube 44. The lower tube 42 includes the lower end 40L of the mast 40, and is secured to the base 55. The upper tube 44 includes the upper end 40U of the mast 40, which is secured directly or indirectly to the arm 50. To accomplish height adjustment, the lower tube 42 and upper tube 44 have a plurality of adjustment holes 46 and pins 47, which may be configured in numerous ways to allow relative longitudinal adjustment of the tubes 42, 44, to allow easy user adjustment. By a preferred embodiment, the upper tube 44 has an upper tube bottom 44B, a main pin 47A extends through one of the adjustment holes 46 in the lower tube 42, and the upper tube 44 rests upon said main pin 47A. Accordingly, in this embodiment, the main pin 47A provides support for the weight of the upper tube 44 and arm 50, but does not actually fix the vertical position of the upper tube.

The relative position of the upper tube 44 and lower tube 42 then, is a function of a pivoting mechanism 70. An example of a suitable pivoting mechanism is illustrated, wherein the pivoting mechanism includes a slot 72 in the lower tube, and a projection 73 from the upper tube 44 that extends through the slot 72, such that axial rotation of the upper tube 44 within the lower tube 42 is governed by the position of the projection 73 within the slot 72. The slot is substantially horizontally oriented, having a pair of slot ends 74E. The slot is arced upwardly, having a midpoint 74M which defines an apex of the slot 72, and thereby creates a movement patterns wherein some effort and kinetic energy is required to move the projection from one of the ends 74E in an uphill direction toward the midpoint 74M (overcoming weight of the arm and upper tube), and once past the midpoint 74M, such kinetic energy is returned by way of seemingly "automatic" movement of the projection 73 the rest of the way to the other of the slot ends 74E. This configuration allows the arm to rest in either the extended or retracted position, resistant to undesired movement of the arm from the wind, yet allows easy deliberate movement of the arm by the boater to bring the arm into the opposite position, where it automatically locks in place. By a preferred embodiment, the projection 73 is an acorn nut 71, which is secured to a bolt 77 that extends fully through the upper tube 44. The bolt has a threaded portion 77T and a bolt head 77H. To suitably position the upper tube at the desired height, the lower tube 42 has an enlarged hole 49 diametrically opposite from the slot 74, so that the bolt can be inserted through the enlarged hole 49, through adjustment holes 46 in the upper tube 44, out through the slot 74, whereupon the acorn nut 71 is mated with the threaded portion 77T of the bolt 77.

Figure 9:
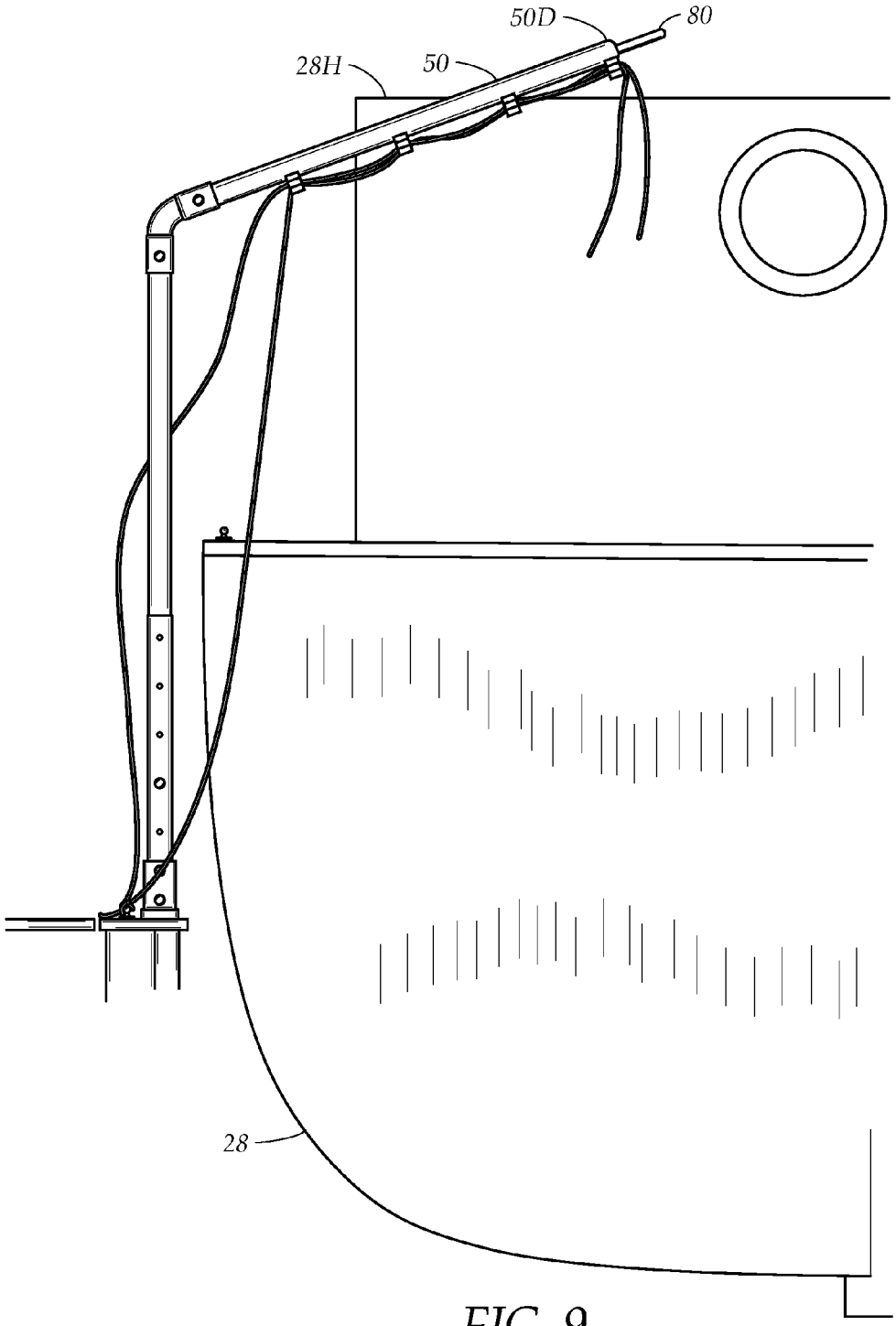
FIG. 9 is an elevational view, illustrating the arm in proximity to a vessel, wherein a portion of the vessel is higher than the arm.
Figure 10:
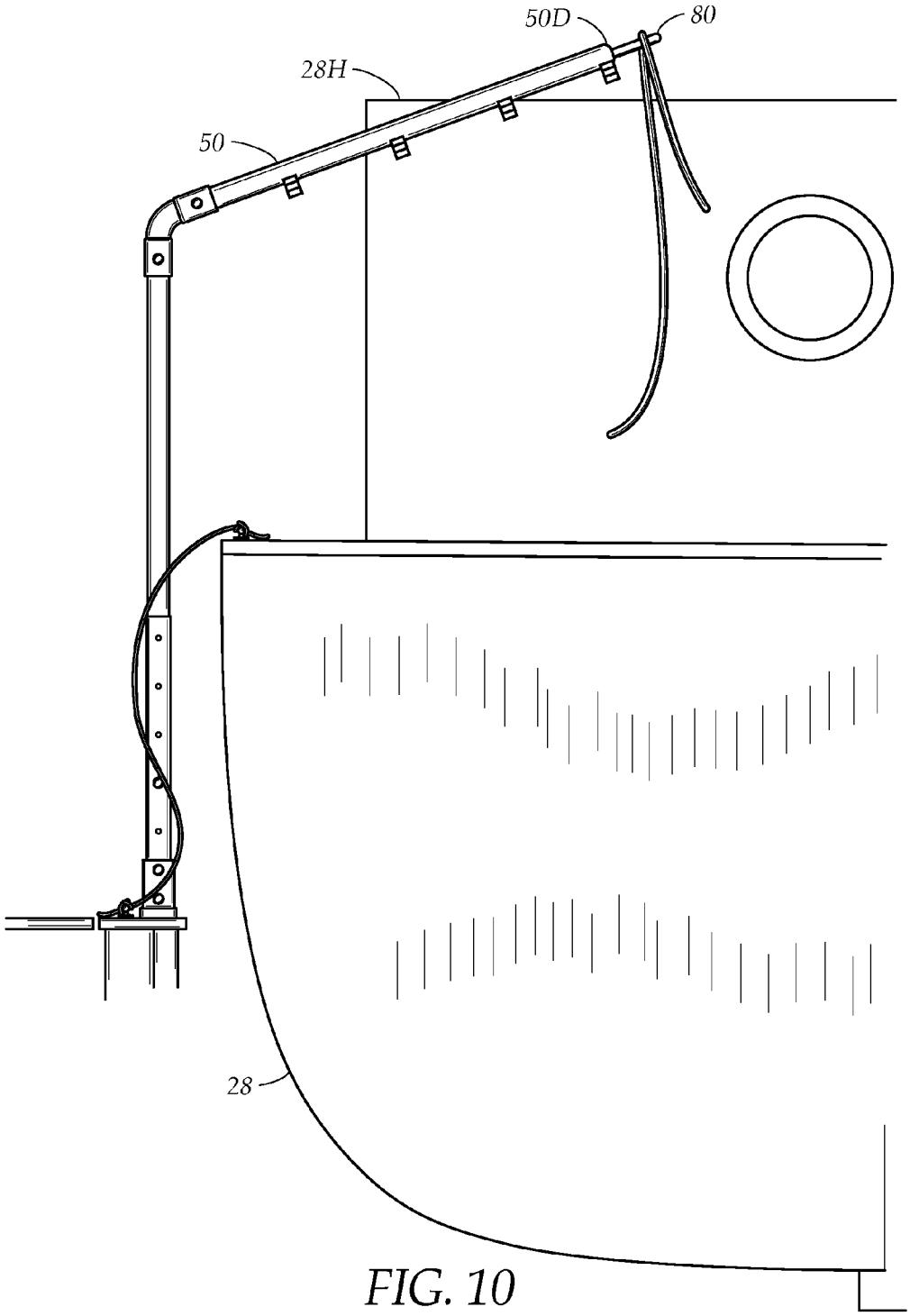
FIG. 10 is an elevational view, similar to FIG. 9, wherein the boat is secured to the dock, and wherein a tether has been threaded through the extension adaptation.

To assist the boater 100 is pivoting the arm into the extended position as the boat 28 leaves the dock, the docking device 20 includes an extension adaptation 80 at the distal end 50D of the arm 50. In particular FIGS. 9 and 10 illustrate a boat 28 having a higher portion 28H that would interfere with the arm 50 as the boat 28 moves along the dock. In such circumstances, it is desirable to have the arm 50 retracted to be substantially parallel the dock while the boat 28 is extending along the dock edge, and then deployed into the extended position only after the boat leaves the dock.

Figure 11A:
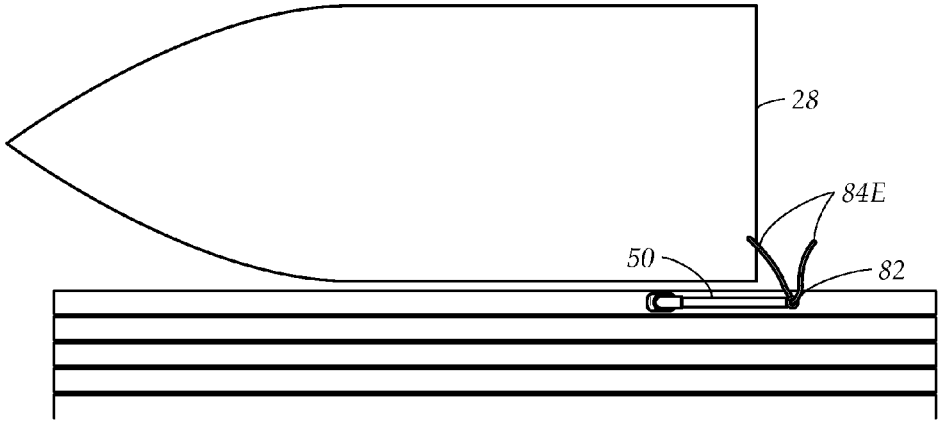
FIG. 11A is a top plan view, illustrating the arm in the retracted position.
Figure 11B:
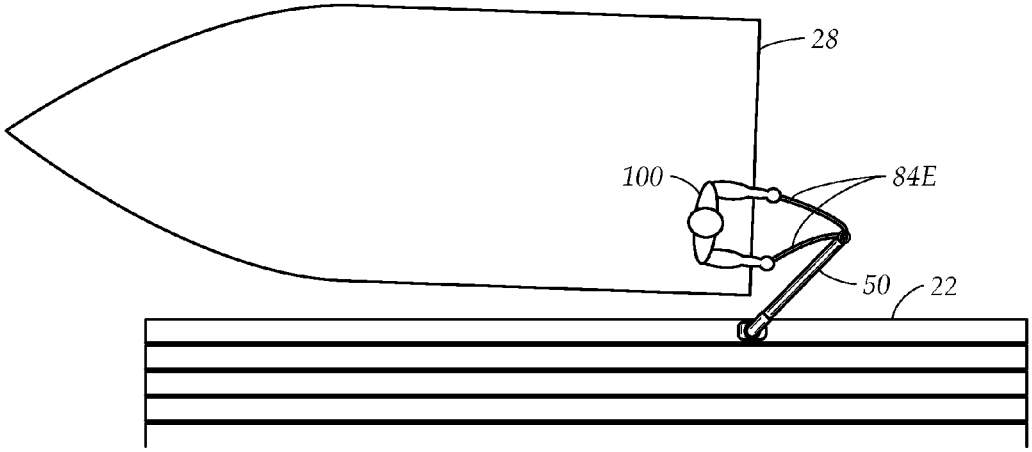
FIG. 11B is a top plan view, similar to FIG. 11A, illustrating the boater urging the arm into the extended position, using the tether, as the boat pulls away from the dock.
Figure 11C:
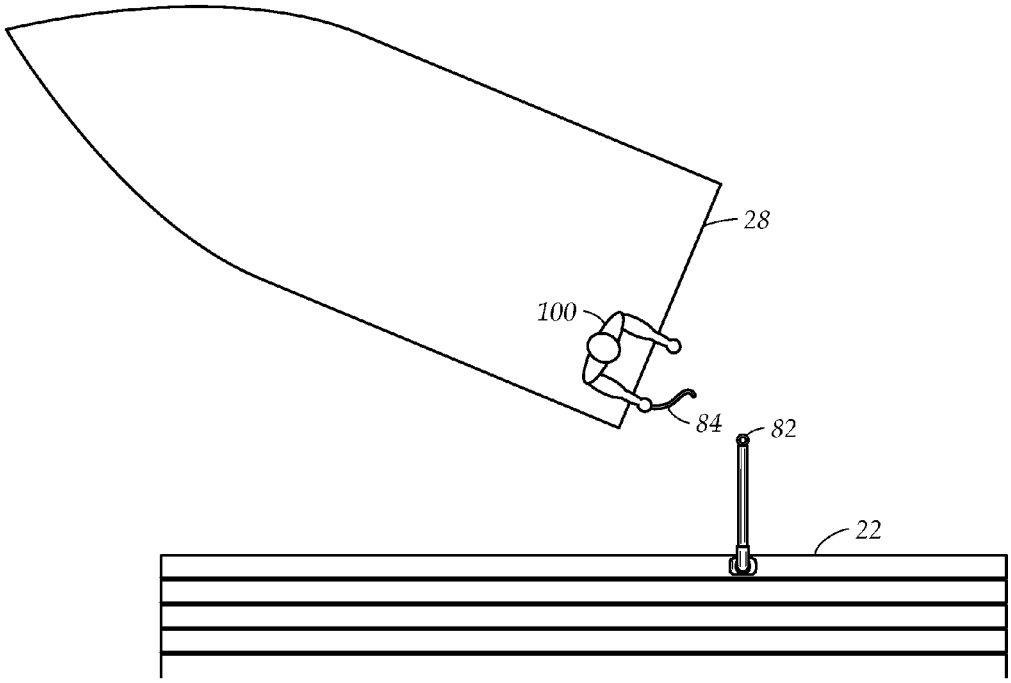
FIG. 11C is a top plan view, similar to FIGS. 11A and 11B, wherein the boater has pulled the arm fully into the extended position, and has released one end of the tether, so that the other end of the tether remains in the hand of the boater after the boat has left the dock area.

Referring to FIG. 8, the extension adaptation 80 may include a closed loop 82—such as an eyelet—and a tether 84. The tether 84 has a pair of ends 84E. Prior to leaving the dock, the boater 100 extends one of the ends 84E through the closed loop 82 until the ends 84E are substantially equidistant from the closed loop 82 (illustrated in FIG. 11A and FIG. 10). The boater 100 then grasps both ends 84E as the boat leaves the dock 22, pulling the arm 50 using the tether 84 into the extended position (illustrated in FIG. 11B). Once the arm 50 is suitably positioned, the boater releases one of the ends 84E, allowing it to flow fully through and free of the closed loop 82, leaving the boater 100 holding the tether 84 as the boat 28 pulls clear of the dock 22 (illustrated in FIG. 11C).

In conclusion, herein is presented a boat docking device that allows a boater to easily obtain dock lines when approaching a dock, without setting foot on the dock. The invention is illustrated by example in the drawing figures, and throughout the written description. It should be understood that numerous variations are possible, while adhering to the inventive concept. Such variations are contemplated as being a part of the present disclosure.

What is claimed is:

1. A boat docking device, for use with a boat, a dock adjacent to a body of water, and at least one line, each line having a pair of ends including a fixed end and a free end, the fixed end of said line secured to the dock, comprising:

a mast having a lower end that is secured to the dock and an upper end;

an arm, having a proximal end, a distal end, and a lower surface the proximal end secured to and extending perpendicularly from the upper end of the mast; and a clip assembly, attached to the lower surface, for selectively and releasably holding the line and allowing it to extend from the proximal end toward the distal end with the free end of the line near the distal end, the line extending substantially parallel to the lower surface, so that when the arm extends over the water, the line can be grasped by the boater when the boat is near the arm as the boat approaches the dock, such that the clip assembly releases the line therefrom to the boater.

2. The boat docking device as described in claim 1, wherein while secured to the dock, the mast allows the arm to rotate substantially ninety degrees between an extended position that is substantially perpendicular to the dock, and a retracted position that is substantially parallel to the dock.

3. The boat docking device as described in claim 2, wherein the clip assembly includes a plurality of clips, spaced apart along the lower surface of the arm, each clip having an opening that selectively enlarges to allow the line to pass into or out of the clip, and selectively reduces to retain the line within the clip.

4. The boat docking device as described in claim 3, further comprising a base at the lower end of the mast for securing to the dock, and wherein the mast comprises at least two telescoping tubes for providing height adjustment of the arm.

5. The boat docking device as recited in claim 4, wherein the mast has a pivoting device which allows axial rotation within a field of substantially ninety degrees to allow movement of the arm between the extended and retracted positions, the pivoting device locking the arm in each of said positions.

6. The boat docking device as recited in claim 5, wherein the at least two tubes include an upper tube and a lower tube, the upper tube attached directly or indirectly to the arm so that axial rotation of the upper tube corresponds with rotation of the arm between its extended and retracted positions, the upper tube is smaller in diameter than the lower tube so that it extends within the lower tube, the lower tube having a circumference and having a tube wall having a substantially horizontally extending slot, the slot extending substantially ninety degrees around the circumference, the slot having a pair of slot ends and a midpoint substantially between the slot ends, the lower tube having an outer surface and having a projection extending from the lower tube and into the slot, the projecting and slot defining and guiding axial rotation of the upper tube with respect to the lower tube.

7. The boat docking device as recited in claim 6, wherein the upper tube and arm have weight, and wherein the slot is vertically arced, so that the midpoint has an apex that is higher than the slot ends, such that this configuration of the slot causes resistance to movement of the arm when resting in either the extended or retracted positions since rotating the arm requires a force that overcomes said weight sufficiently to lift the upper tube and arm within the slot as it rotates from one slot end toward the apex, and then said weight helps to carry the upper tube and arm toward the other slot as the projection moves downwardly from the apex within the slot.

8. The boat docking device as recited in claim 7, further comprising a main pin, wherein the upper tube has a bottom, wherein the lower tube has a plurality of height adjustment holes, the main pin selectively extends through one of the height adjustment holes such that the bottom of the upper tube rests upon the main pin.

9. The boat docking device as recited in claim 8, wherein the dock has a cleat having a pair of feet that are secured to the dock, and a main body that is suspended above the dock by the feet and extends between the feet and has horns that overhang outwardly of each of the feet, wherein the base of the docking device has a strap, a main block having a rear face and a bottom surface, and a pair of wedges extending from the rear face near the bottom surface, so that the wedges can be extended beneath each of the horns of the cleat, and the strap secured to each of said horns and around the front face of the main block to secure the base to the cleat and thereby removably secure the docking device to the dock.

10. The boat docking device as recited in claim 9, further having an extension adaptation located at the distal end of the arm, including a tether, the tether allowing the arm to be pulled toward the extended position by the boater as the boater leaves the dock.

11. The boat docking device as recited in claim 10, wherein the extension adaptation includes a closed loop through which the tether selectively extends, the tether having a pair of ends so that the boater can extend one of the ends of the tether through the loop, grasp both ends of the tether to pull against the loop to move the arm as the boat pulls away from the dock, let go of one of the ends of the tether so that the tether pulls fully through and free of the loop so that the boater is left holding the tether after the boat has left the dock.

12. A boat docking device, for use with a boat, a dock adjacent to a body of water, and at least one line, each line having a pair of ends including a fixed end and a free end, the fixed end of said line secured to the dock, the dock also having at least one cleat, the cleat having a pair of feet that are fastened to the dock surface, and a main body having a pair of horns that extend outwardly of the feet, comprising:

a base having a base block, the base block having a front face, a rear face, and a bottom surface, the base block having a pair of wedges extending from the rear face near the bottom surface, the wedges having a space therebetween, so that the wedges can extend snugly beneath the horns with the feet of the cleat extending between the wedges; and a strap, having a pair of strap ends, the strap for extending around the front face of the base block; and an arm, attached to the base block, so that when the base block is secured to said cleat, the arm can extend outwardly over the water for holding the free end of the line in a position where it can be reached by a boater before the boat reaches the dock.

13. The boat docking device as recited in claim 12, wherein the base block has side faces extending between the front face and rear face, the base block further comprising strap guides on at least one of the side faces and front face, the strap selectively extending through the strap guides to prevent movement of the base block when the base block is secured to the cleat with the strap.

14. The boat docking device as recited in claim 13, further comprising a mast having an upper end, and having a lower end that is secured to the base block; wherein the arm has a proximal end, a distal end, and a lower surface, the proximal end is secured to and extending perpendicularly from the upper end of the mast, such that the mast secures the arm to the base block.

15. The boat docking device as recited in claim 14, further comprising a clip assembly, attached to the lower surface, for selectively and releasably holding the line and allowing it to extend from the proximal end toward the distal end with the free end of the line near the distal end, the line extending substantially parallel to the lower surface, so that when the arm extends over the water, the line can be grasped by the boater when the boat is near the arm as the boat approaches the dock, such that the clip assembly releases the line therefrom to the boater.

16. The boat docking device as recited in claim 15, wherein the mast includes at least two telescoping tubes to provide height adjustment of the arm, the at least two telescoping tubes including an upper tube and a lower tube, the upper tube attached directly or indirectly to the arm so that axial rotation of the upper tube allows rotation of the arm between an extended position substantially perpendicular to the dock, and a retracted position substantially parallel to the dock, the upper tube is smaller in diameter than the lower tube so that it extends within the lower tube, the lower tube having a circumference and having a tube wall having a substantially horizontally extending slot, the slot extending substantially ninety degrees around the circumference, the slot having a pair of slot ends and a midpoint substantially between the slot ends, the lower tube having an outer surface and having a projection extending from the lower tube and into the slot, the projecting and slot defining and guiding axial rotation of the upper tube with respect to the lower tube.

* * * * *